US006569061B2

(12) United States Patent
Stearns et al.

(10) Patent No.: US 6,569,061 B2
(45) Date of Patent: May 27, 2003

(54) METHODS AND APPARATUS FOR LINKING ARM EXERCISE MOTION TO LEG EXERCISE MOTION

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 86 days.

(21) Appl. No.: 09/796,122

(22) Filed: Feb. 28, 2001

(65) Prior Publication Data

US 2002/0119867 A1 Aug. 29, 2002

(51) Int. Cl.[7] ..... A63B 22/00; A63B 69/16
(52) U.S. Cl. ..... 482/52; 482/51; 482/57
(58) Field of Search ..... 482/51, 52, 53, 482/57, 70, 79, 80, 58–63

(56) References Cited

U.S. PATENT DOCUMENTS

| | | | | | |
|---|---|---|---|---|---|
| 4,509,742 | A | * | 4/1985 | Cones | 482/58 |
| 5,868,650 | A | * | 2/1999 | Wu | 482/62 |
| 6,277,055 | B1 | * | 8/2001 | Birrell et al. | 482/52 |
| 6,485,395 | B1 | * | 11/2002 | Stearns et al. | 482/57 |

* cited by examiner

*Primary Examiner*—Stephen R. Crow

(57) ABSTRACT

An exercise apparatus includes a frame, left and right leg members pivotally mounted on the frame, and left and right handlebars pivotally mounted on the frame. Various arrangements are provided to facilitate switching, during leg exercise motion, between a first mode of operation involving commensurate arm exercise motion and leg exercise motion, and a second mode of operation involving leg exercise motion without commensurate arm exercise motion.

8 Claims, 4 Drawing Sheets

Fig. 2
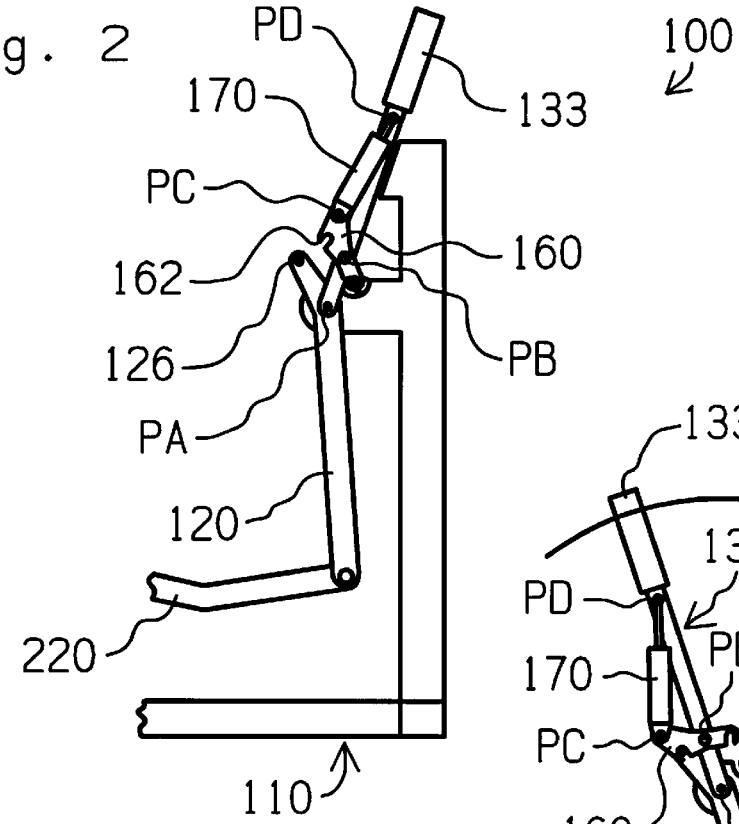
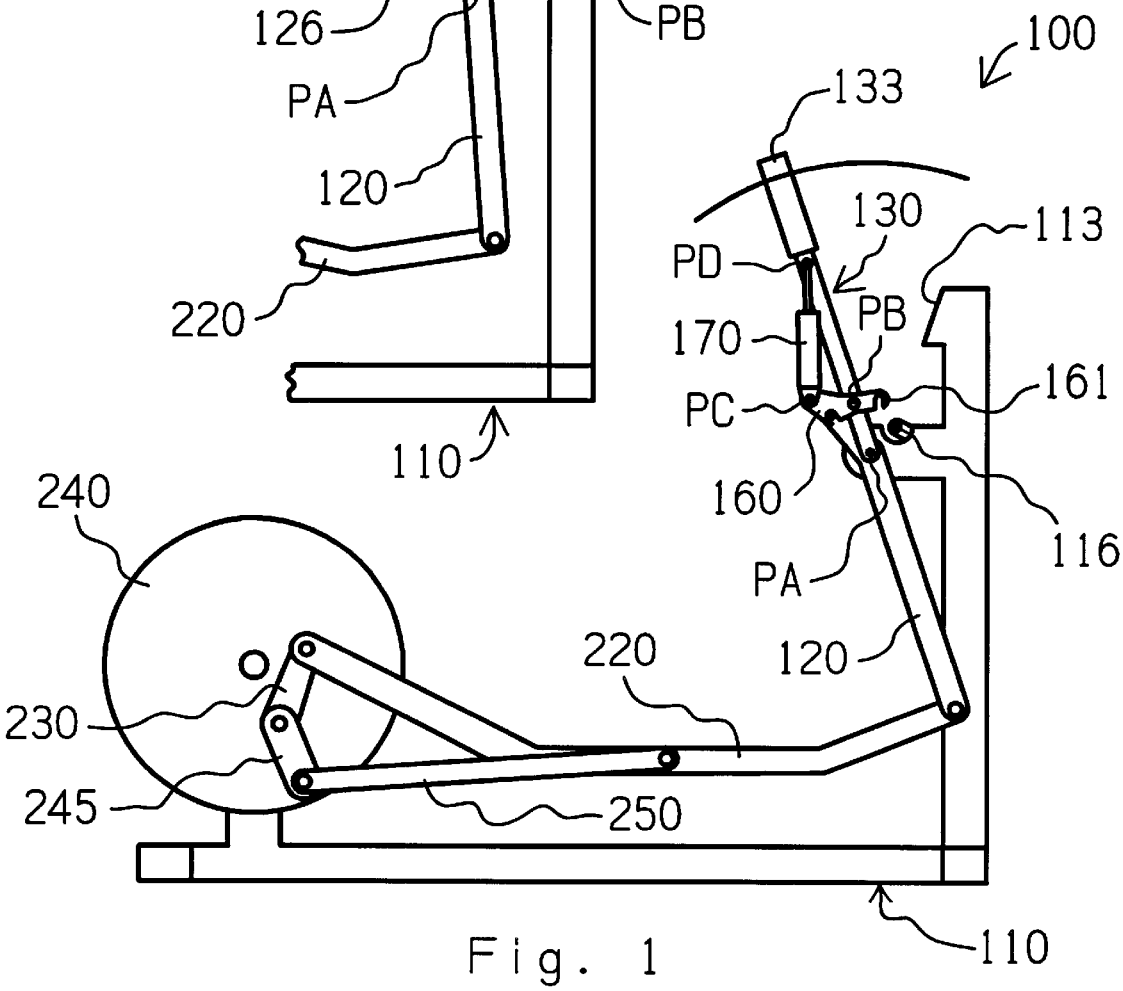
Fig. 1

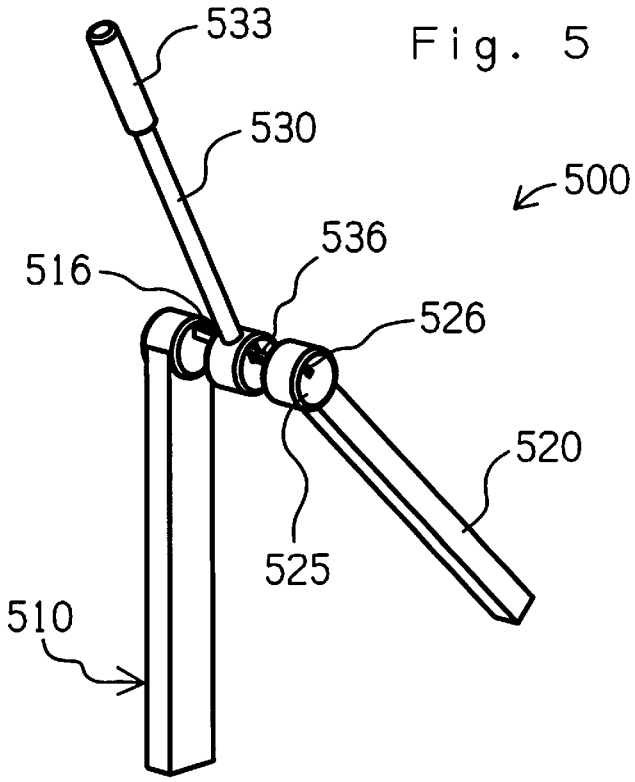
Fig. 5
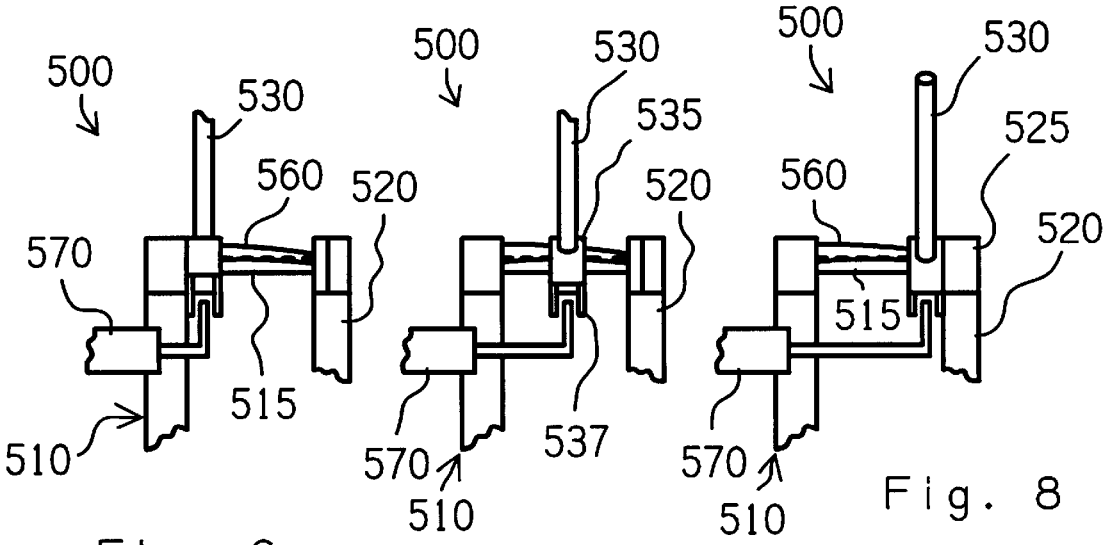
Fig. 6
Fig. 7
Fig. 8

METHODS AND APPARATUS FOR LINKING ARM EXERCISE MOTION TO LEG EXERCISE MOTION

FIELD OF THE INVENTION

The present invention relates to exercise methods and apparatus and more particularly, to unique linkage arrangements between handlebars and leg driven members which are suitable for use on various types of exercise equipment, including elliptical motion exercise machines.

BACKGROUND OF THE INVENTION

Exercise equipment has been designed to facilitate a variety of exercise motions, many of which incorporate both arm and leg movements. Examples of such equipment include elliptical exercise machines (see U.S. Pat. Nos. 5,242,343, 5,423,729, 5,540,637, 5,725,457, 5,792,026, and 5,895,339); free form exercise machines (see U.S. Pat. Nos. 5,290,211, 5,299,993, 5,401,226, and 5,499,956); rider exercise machines (see U.S. Pat. Nos. 2,603,486, 5,695,434, 5,997,446); glider/strider exercise machines (see U.S. Pat. Nos. 4,940,233, 5,795,268); stepper exercise machines (see U.S. Pat. No. 4,934,690); bicycle exercise machines (see U.S. Pat. Nos. 4,188,030 and 4,509,742); and other, miscellaneous exercise machines (see U.S. Pat. Nos. 4,869,494 and 5,039,088). These patents are incorporated herein by reference to show suitable applications for the present invention.

Some of these "total body" exercise machines have been developed to provide independent upper body exercise and lower body exercise. One such machine is the NordicTrack ski machine (an example of which is shown in U.S. Pat. No. 4,728,102). On machines of this type, left and right hand grips operate independent of left and right skis, and a person can either use or stow the exercise hand grips without interrupting leg activity. Unfortunately, many people consider these ski machines relatively difficult to use, due to the independent, or uncoordinated nature of the arm motion and the leg motion.

On other "total body" exercise machines, arm driven members and leg driven members are linked to facilitate synchronized, or coordinated arm and leg exercise motion. The synchronized motion is considered advantageous to the extent that it makes the equipment relatively easy to use. However, the handles are typically constrained to move back and forth regardless of whether or not the user wishes to move his arms while moving his legs. As a result, the synchronized arms often become a nuisance and/or a potential source of injury for people who wish to focus solely on lower body exercise and/or choose to perform other tasks with their arms. In other words, room for improvement remains with respect to total body exercise equipment.

SUMMARY OF THE INVENTION

The present invention provides unique methods and apparatus for linking a handlebar to a member associated with exercise of a person's leg ("leg member"). The present invention may be implemented in various ways to achieve various results. For example, the present invention may be described in terms of allowing a person to switch between (a) commensurate arm exercise motion and leg exercise motion, and (b) leg exercise motion without commensurate arm exercise motion. Many of the features and advantages of the present invention may become more apparent from the detailed description that follows.

BRIEF DESCRIPTION OF THE DRAWING

With reference to the Figures of the Drawing, wherein like numerals represent like parts and assemblies throughout the several views, FIG. 1 is a side view of an exercise apparatus constructed according to the principles of the present invention, showing the apparatus configured for commensurate arm and leg exercise motions;

FIG. 2 is a fragmentary side view of the exercise apparatus of FIG. 1, showing the apparatus configured for leg exercise motion without commensurate arm exercise motion;

FIG. 5 is a fragmentary perspective view of an alternative linkage assembly constructed according to the principles of the present invention;

FIG. 6 is a fragmentary front view of the linkage assembly of FIG. 5, showing the assembly configured for leg exercise motion without commensurate arm exercise motion;

FIG. 7 is a fragmentary front view of the linkage assembly of FIG. 5, showing the assembly configured for leg exercise motion and a moderate amount of arm exercise motion;

FIG. 8 is a fragmentary front view of the linkage assembly of FIG. 5, showing the assembly configured for commensurate arm and leg exercise motions;

DETAILED DESCRIPTION OF THE PREFERRED EMBODIMENT

Figures 3, 4:
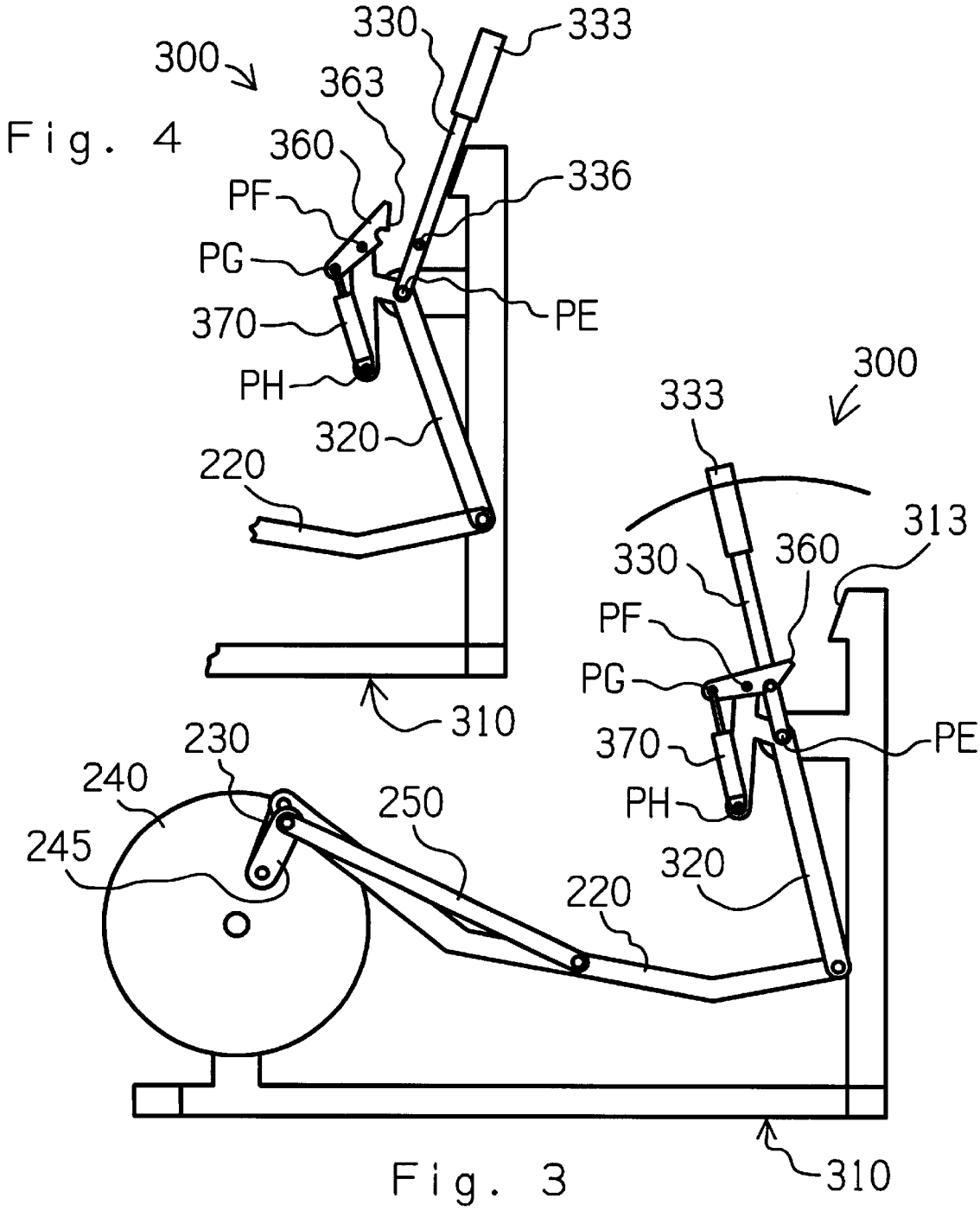
FIG. 3 is a side view of another exercise apparatus constructed according to the principles of the present invention, showing the apparatus configured for commensurate arm and leg exercise motions.
FIG. 4 is a fragmentary side view of the exercise apparatus of FIG. 3, showing the apparatus configured for leg exercise motion with commensurate arm exercise motion.

For ease of reference, the accompanying figures show only the right side components of each embodiment, with the understanding that corresponding part(s) are disposed on the opposite side of the apparatus, and that each embodiment is generally symmetrical about a centrally located, vertical plane (the primary exception being the relative orientation of components disposed on opposite sides of the plane of symmetry). Generally speaking, the "right-hand" components are one hundred and eighty degrees out of phase relative to the "left-hand" components. In any event, like reference numerals are used to designate both the "right-hand" and "left-hand" parts, and when reference is made to one or more parts on only one side of an apparatus, it is to be understood that corresponding part(s) are disposed on the opposite side of the apparatus. Parts that are intersected by the plane of symmetry exist individually and thus, do not have any "opposite side" counterparts.

A first exercise apparatus constructed according to the principles of the present invention is designated as 100 in FIGS. 1–2. The apparatus 100 may be described as an elliptical motion exercise machine that provides leg exercise motion in a manner similar to an exercise machine disclosed in U.S. Pat. No. 5,792,026 (which is incorporated herein by reference), and that provides a unique linkage arrangement between left and right leg members 120 and respective left and right handlebars 130. However, the present invention is not limited to this specific type of exercise machine, nor to any particular category of exercise machine, but rather, is suitable for use on various sorts of exercise equipment. Examples of other suitable applications are mentioned above with reference to other patents that have been incorporated herein by reference.

The leg member 120 may be described in terms of upper and lower portions that extend radially away from the leg pivot axis PA. As more fully described in U.S. Pat. No. 5,792,026, a lower distal end of each leg member 120 is pivotally connected to a forward end of a respective foot supporting link 220. An opposite, rearward end of each foot supporting link 220 is pivotally connected to the upper end of a respective floating crank 230. An opposite lower end of each floating crank 230 is pivotally connected to a respective crank 240, which in turn, is rotatably mounted on a floor engaging frame 110. Left and right crank extensions 245 have radially inward ends rigidly connected to respective cranks 240, and radially outward ends pivotally connected to rearward ends of respective drawbars 250. Each drawbar 250 has an opposite, forward end pivotally connected to an intermediate portion of a respective foot supporting link 220. As a result of this arrangement, an intermediate portion of each foot supporting link 220 moves through a generally elliptical path as each crank 240 rotates and each leg member 120 pivots.

A flywheel may be connected to the cranks 240 to add inertia to the linkage assembly, and various types of known resistance mechanisms may be connected to the flywheel to add resistance, as well. For example, a drag strap may be disposed about the circumference of the flywheel and maintained in tension as shown in U.S. Pat. No. 4,023,795, which is incorporated herein by reference. Other suitable resistance mechanisms include known electrical braking arrangements and other known types of mechanical braking arrangements.

The depicted leg member 120 may be described as a rocker link that is pivotally connected to the frame 110 at pivot axis PA. A peg 126 protrudes laterally outward from the upper distal end of the leg member 120. The handlebar 130 may similarly be described as a rocker link that is pivotally connected to frame 110 at pivot axis PA. An upper distal end 133 of the handlebar 130, opposite the pivot axis PA, is sized and configured for grasping.

A hook member 160 has an intermediate portion that is pivotally connected to the handlebar 130 at pivot axis PB. A forward end 161 of the hook member 160 is configured and arranged to engage a laterally extending peg 116 on the frame 110 (as shown in FIG. 2). When so engaged, the hook member 160 prevents rearward pivoting of the handlebar 130, and a bearing surface 113 on the frame 110 prevents forward pivoting of the handlebar 130. An opposite, relatively rearward portion 162 of the hook member 160 is configured and arranged to engage the peg 126 on the leg member 120 (as shown in FIG. 1). When so engaged, the hook member 160 constrains the handlebar 130 to pivot together with the leg member 120. The hook member 160 and the pegs 116 and 126 are arranged so that the pegs 116 and 126 are alternatively engaged and disengaged.

On the depicted embodiment 100, a conventional actuator 170 is provided to operate the hook member 160. A cylinder end of the actuator 170 is pivotally connected to a rearward distal end of the hook member 160 at pivot axis PC, and an opposite, rod end of the actuator 170 is pivotally connected to the handlebar 130 at pivot axis PD. Each actuator 170 is preferably allowed to operate only when the respective handlebar 130 is at its forwardmost position. Sensors may be used to signal either the user or a control program regarding the proper time to operate each actuator 170.

The actuator 170 extends to a relatively greater length in order to connect the hook member 160 to the leg member 120, thereby configuring the apparatus 100 for commensurate arm and leg exercise motions. Conversely, the actuator 170 retracts to a relatively shorter length in order to connect the hook member 160 to the frame 110, thereby configuring the apparatus 100 for leg exercise motion without commensurate arm exercise motion. The operation of the leg exercising portion of the machine 100 is the same regardless of how the handlebars 130 are set, and the status of the handlebars 130 may be switched without any disruption of the leg exercise motion. Moreover, the arrangement is such that any movement of the handlebars 130 remains synchronized relative to respective leg members 120.

A second exercise apparatus constructed according to the principles of the present invention is designated as 300 in FIGS. 3–4. The apparatus 300 may be similarly described as an elliptical motion exercise machine that provides leg exercise motion in a manner similar to an exercise machine disclosed in U.S. Pat. No. 5,792,026, and that provides a unique linkage arrangement between left and right leg members 320 and respective left and right handlebars 330.

The depicted leg member 320 may be described as a rocker link that is pivotally connected to the frame 310 at pivot axis PE, and the handlebar 330 may be similarly described as a rocker link that is pivotally connected to frame 310 at pivot axis PE. An upper distal end 333 of the handlebar 330, opposite the pivot axis PE, is sized and configured for grasping. Also, a peg 336 extends laterally outward from an intermediate portion of the handlebar 330.

A hook member 360 has an intermediate portion that is pivotally connected to the leg member 320 at pivot axis PF. A forward end 363 of the hook member 360 is configured and arranged to engage the peg 336 on the handlebar 330 (as shown in FIG. 3). When so engaged, the hook member 360 constrains the handlebar 330 to pivot together with the leg member 320. In the alternative, the hook member 360 is movable to the position shown in FIG. 4, and the handlebar 330 occupies a rest position against a bearing surface 313 on the frame 310. The force of gravity acting on the handlebar 330 biases the handlebar 330 to remain in the rest position shown in FIG. 4, and a magnet is preferably provided proximate the bearing surface 313 to further stabilize the handlebar 330 in its rest position.

On the depicted embodiment 300, a similar conventional actuator 370 is provided to operate the hook member 360. A rod end of the actuator 370 is pivotally connected to a rearward distal end of the hook member 360 at pivot axis PG, and an opposite, cylinder end of the actuator 370 is pivotally connected to the leg member 320 at pivot axis PH. Each actuator 370 is preferably allowed to operate only when the respective handlebar 330 is at its forwardmost position. Also, the forward "leading" end of the hook member 360 is preferably configured to help guide the hook member 360 into engagement with the peg 336.

The actuator 370 extends to a relatively greater length in order to connect the hook member 360 to the handlebar 330, thereby configuring the apparatus 300 for commensurate arm and leg exercise motions. Conversely, the actuator 370 retracts to a relatively shorter length in order to leave the handlebar 330 resting against the frame 310, thereby configuring the apparatus 300 for leg exercise motion without commensurate arm exercise motion. The operation of the leg exercising portion of the machine 300 is the same regardless of how the handlebars 330 are set, and the status of the handlebars 330 may be switched without any disruption of the leg exercise motion. Moreover, the arrangement is such that any movement of the handlebars 330 remains synchronized relative to respective leg members 320.

A third exercise apparatus constructed according to the principles of the present invention is designated as 500 in FIGS. 5–8. The apparatus 500 may be similarly described as an elliptical motion exercise machine that provides leg exercise motion in a manner similar to an exercise machine disclosed in U.S. Pat. No. 5,792,026, and that provides a unique linkage arrangement between left and right leg members 520 and respective left and right handlebars 530.

The apparatus 500 includes a frame member 510, a shaft 515 that is rigidly secured to the frame member 510 and projects horizontal outward from the frame member 510; and a leaf spring 560 that extend along an upper edge of the shaft 515. An end of the leaf spring 560 is anchored within a slot 516 in the frame member 510. The depicted handlebar 530 has an upper end 533 that is sized and configured for grasping, and an opposite, lower end that is connected to a hub 535. The handlebar hub 535 is rotatably mounted on the shaft 515, and the leaf spring 560 extends through a slot 536 in the handlebar hub 535. The depicted leg member 520 has a lower end that is connected to a foot supporting link (not shown), and an opposite, upper end that is connected to a leg hub 525. The leg hub 525 is rotatably mounted on the shaft 515 and secured against axial movement relative to the shaft 515, and an opposite end of the leaf spring 560 is anchored within a slot 526 in the leg hub 525.

As a result of the foregoing arrangement, the handlebar hub 535 is slidable along the shaft 515 and the leaf spring 560. When the handlebar hub 535 is proximate the frame member 510 (as shown in FIG. 6), a relatively long section of the leaf spring 560 is disposed between the handlebar hub 535 and the leg hub 525, thereby accommodating relatively greater rotation of the leg member 520 relative to the handlebar 530. When the handlebar hub 535 is moved proximate the leg hub 525 (as shown in FIG. 8), little, if any, of the leaf spring 560 is disposed between the two hubs 535 and 525, thereby constraining the two hubs 535 and 525 to essentially rotate together. FIG. 7 shows the handlebar hub 535 at an intermediate position between the two extremes.

On the depicted embodiment 500, a conventional actuator 570 is provided to move the handlebar hub 535 along the shaft 515. In this regard, a sheave 537 is provided on the handlebar hub 535, and a rod end of the actuator 570 is disposed within the sheave 537. An opposite, cylinder end of the actuator 570 is connected to the frame member 510. The actuator 570 extends to a relatively greater length to move the handlebar hub 535 toward the leg hub 525, thereby increasing the effective link between arm exercise motion and leg exercise motion. Conversely, the actuator retracts to a relative shorter length to move the handlebar hub 535 away from the leg hub 525, thereby decreasing the effective link between arm exercise motion and leg exercise motion. As on the other embodiments, the operation of the leg exercising portion of the machine 500 is the same regardless of how the handlebars 530 are set, and the status of the handlebars 530 may be switched without any disruption of the leg exercise motion. Moreover, the arrangement always biases any movement of the handlebars 530 to remain synchronized relative to respective leg members 520.

Figures 9, 10:
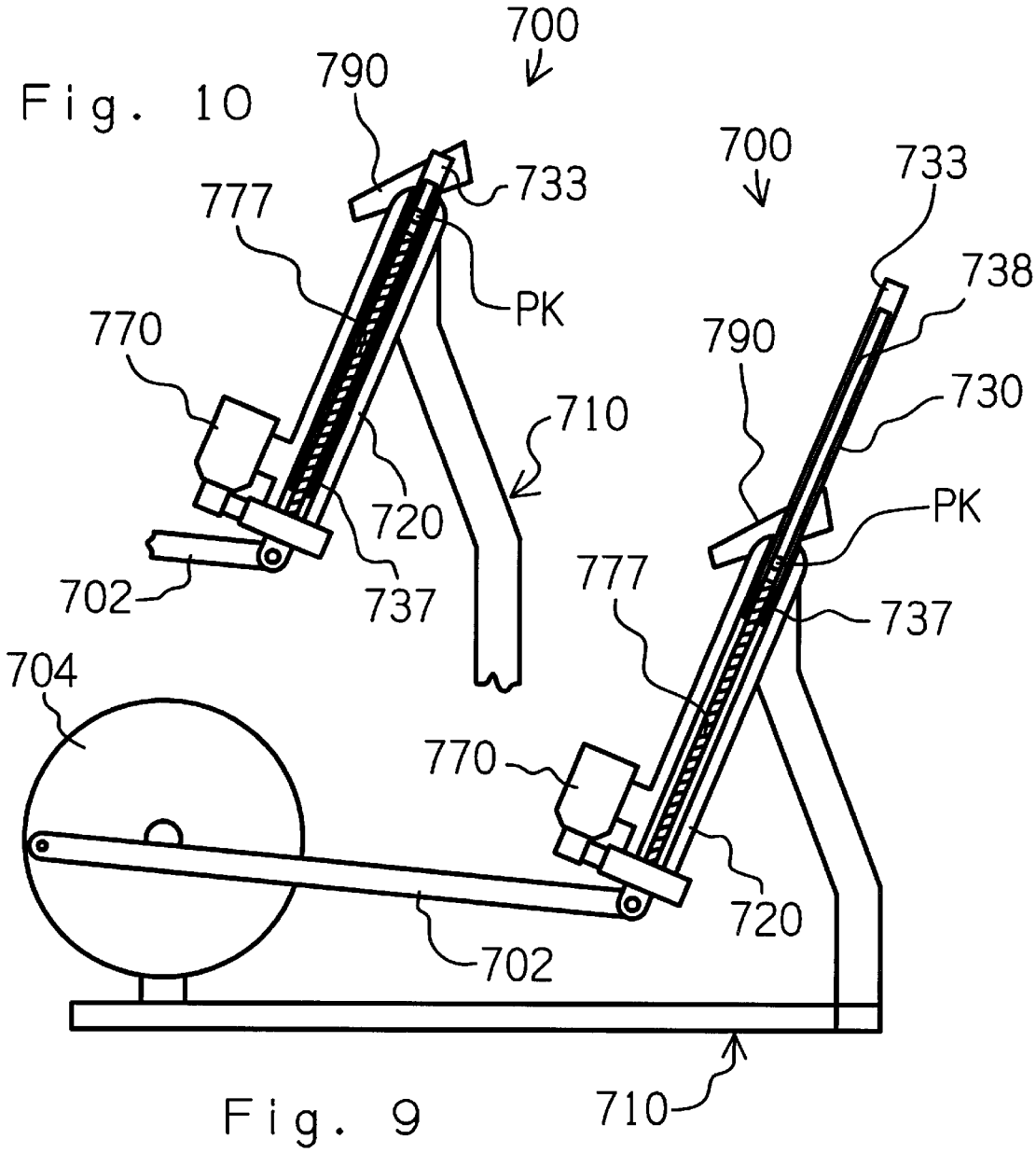
FIG. 9 is a fragmentary side view of yet another exercise apparatus constructed according to the principles of the present invention, showing the apparatus configured for commensurate arm and leg exercise motion.
FIG. 10 is a fragmentary side view of the exercise apparatus of FIG. 9, showing the apparatus configured for leg exercise motion without commensurate arm exercise motion.

A fourth exercise apparatus constructed according to the principles of the present invention is designated as 700 in FIGS. 9–10. The apparatus 700 may be described as an elliptical motion exercise machine that provides leg exercise motion in a manner similar to an exercise machine disclosed in U.S. Pat. No. 5,383,829, and that provides a unique linkage arrangement between left and right leg members 720 and respective left and right handlebars 730.

The depicted leg member 720 may be described as a rocker link having an upper end that is pivotally connected to the frame 710 at pivot axis PK, and a lower end that is pivotally connected to a forward end of a respective foot supporting link 702. An opposite, rearward end of each foot supporting link 702 is pivotally connected to a respective crank 704, which in turn, is rotatably mounted on a floor engaging frame 710.

The handlebar 730 is slidably connected to the leg member 720 for movement in telescoping fashion relative thereto. The handlebar 730 has an upper end 733 that is sized and configured to receive a tubular hand grip (not shown). A threaded nut 737 is secured to an opposite, lower end of the handlebar 730. The nut 737 is aligned with a central bore 738 that extends lengthwise inside the handlebar 730.

A motor 770 is mounted on the lower end of the leg member 720. A lead screw 777 has a lower end rigidly connected to the output shaft of the motor 770, and an opposite, upper end threaded through the nut 737. As a result of this arrangement, rotation of the lead screw 777 in a first direction causes the nut 737 to travel up the lead screw 777, thereby moving the handlebar 730 upward relative to the leg member 720, toward the position shown in FIG. 9. When configured as shown in FIG. 9, the apparatus 700 provides arm exercise motion that is commensurate with leg exercise motion. Conversely, rotation of the lead screw 777 in an opposite, second direction causes the nut 737 to travel down the lead screw 777, thereby moving the handlebar 730 downward relative to the leg member 720, toward the position shown in FIG. 9. When configured as shown in FIG. 10, the apparatus 700 provides leg exercise motion without commensurate arm exercise motion.

Like the previous embodiment 500, the apparatus 700 provides intermediate levels of arm exercise motion relative to leg exercise motion, and as on all of the preceding embodiments, the operation of the leg exercising portion of the machine 700 is the same regardless of how the handlebars 730 are set, and the status of the handlebars 730 may be switched without any disruption of the leg exercise motion. Moreover, the arrangement always constrains the handlebars 730 to remain synchronized relative to respective leg members 720. Yet another advantage of the apparatus 700 is that handlebars 730 move downward as their stroke length is decreased.

Each of the foregoing embodiments may be designed to operate in response to various signals and/or under various circumstances. For example, control signals may be generated by (a) the user pushing a button on a user interface (like the one designated as 790 in FIGS. 9–10); (b) a sensor detecting the presence or absence of the user's hands on the handles; (c) a sensor detecting that the user's level of exertion is outside a target range; (d) an automated program; and/or (e) a person other than the user (such as a trainer) who is in communication with the apparatus. Moreover, the interface 790 may be configured to perform a variety of functions, including (1) displaying information to the user, including (a) exercise parameters and/or programs, (b) the current parameters and/or currently selected program, (c) the current time, (d) the elapsed exercise time, (e) the current speed of exercise, (f) the average speed of exercise, (g) the number of calories burned during exercise, (h) the simulated distance traveled during exercise, (i) material transmitted over the internet, and/or (j) amounts of work currently being performed by the user's arms and/or legs; and/or (2) allowing the user to (a) select or change the information being viewed, (b) select or change an exercise program, (c) adjust the resistance to exercise (of the arms and/or the legs), (d) adjust the stroke length (of the arms and/or the legs), (e) adjust the orientation of the exercise motion, and/or (f) quickly stop the exercise motion (of the arms and/or the legs).

On each of the foregoing embodiments, power is required for purposes of adjusting operation of the handlebars. Power may be supplied to these devices using cords that are routed through or along the associated linkage component to a pivot axis, then through or along the pivot axis to the machine frame, and then to a power supply on the machine frame. In the alternative, these powered devices may be eliminated and/or replaced by manual devices. For example, the motor and lead screw arrangement may be removed from the apparatus 700, and the handlebars 730 may be moved up and down subject to the force of gravity, and/or the handlebars 730 may be pinned or latched in place. Also, the actuator may be removed from the apparatus 500, and the handlebar 530 may be moved back and forth subject to frictional resistance, and/or the handlebars 730 may be held in discrete positions by a spring detent. Also, various mechanical arrangements may be provided to operate the hook members on the apparatus 100 and 300. In other words, adjustments may be driven by a power supply, performed manually, or performed using work generated during exercise activity.

The present invention also provides various methods which may be implemented in accordance with the embodiments discussed above. Recognizing that this disclosure will enable persons skilled in the art to recognize various embodiments, modifications, and/or applications, the scope of the present invention is to be limited only to the extent of the claims which follow.

What is claimed is:

1. An exercise apparatus, comprising:

a frame designed to rest upon a floor surface;

a left leg member and a right leg member, wherein each said leg member is pivotally connected to said frame at a pivot axis and operable to facilitate leg exercise motion;

a left handlebar and a right handlebar, wherein each said handlebar is pivotally connected to said frame at said pivot axis and operable to facilitate arm exercise motion; and a means for switching, during leg exercise motion, between a first mode of operation involving commensurate arm exercise motion and leg exercise motion, and a second mode of operation involving leg exercise motion without commensurate arm exercise motion.

2. The exercise apparatus of claim 1, wherein said means includes a left spring and a right spring, and each said spring is interconnected between the frame, a respective handlebar, and a respective leg member.

3. An exercise apparatus, comprising:

a frame designed to rest upon a floor surface;

a left leg member and a right leg member, wherein each said leg member is pivotally connected to said frame at a pivot axis and operable to facilitate leg exercise motion;

a left handlebar and a right handlebar, wherein each said handlebar is pivotally connected to said frame at said pivot axis and operable to facilitate arm exercise motion; and a left spring and a right spring, wherein each said spring is interconnected between the frame, a respective handlebar, and a respective leg member.

4. The exercise apparatus of claim 3, wherein each said spring extends parallel to said pivot axis when in a relaxed state.

5. The exercise apparatus of claim 3, wherein each said handlebar is movable along a respective said spring.

6. The exercise apparatus of claim 3, wherein each said handlebar is movable axially across a gap defined between the frame and a respective said leg member.

7. The exercise apparatus of claim 6, wherein each said spring spans a respective said gap and extends through a respective said handlebar.

8. The exercise apparatus of claim 3, wherein each said spring has a first end fastened to a respective said leg member, an opposite, second end fastened to the frame, and an intermediate portion that extends through a respective said handlebar.

* * * * *